US005407204A

United States Patent [19]

Meyer, III

[11] Patent Number: 5,407,204

[45] Date of Patent: Apr. 18, 1995

[54] BASEBALL CARD BOARD GAME

[76] Inventor: Albert G. Meyer, III, 11 Brooklawn Ave., Augusta, Me. 04330

[21] Appl. No.: 219,704

[22] Filed: Mar. 29, 1994

[51] Int. Cl.[6] ..... A63F 3/00; G09F 1/12

[52] U.S. Cl. ..... 273/244; 273/237; 273/93 C; 273/288; 273/289; 273/148 A; 40/152.1

[58] Field of Search ..... 273/93 C, 93 R, 244, 273/238, 148 A, 298, 292, 156, 159, 157, 288, 289; 40/661, 492, 152.1

[56] References Cited

U.S. PATENT DOCUMENTS

| | | | |
|---|---|---|---|
| 2,742,290 | 4/1956 | Fasana | 273/93 C |
| 5,087,050 | 2/1992 | Donovan | 273/237 |
| 5,137,279 | 8/1992 | Murphy et al. | 273/257 |
| 5,201,520 | 4/1993 | Castle et al. | 273/88 |
| 5,251,904 | 10/1993 | Cruz et al. | 273/243 |

FOREIGN PATENT DOCUMENTS

| | | | |
|---|---|---|---|
| 641446 | 8/1962 | Italy | 273/244 |

*Primary Examiner*—Benjamin H. Layno

[57] ABSTRACT

A board game for simulating the game of baseball in which baseball trading cards are utilized as playing pieces. The game includes a board having a baseball diamond pictured thereon and a plurality of card holders into which baseball trading cards may be positioned. A deck of pitcher cards provides a random pitch to a player at bat, such as a strike, ball, or hit, and a deck of action cards provides a random result of the batter's action, such as a hit, out, or homerun. The game pieces are then moved in accordance with the rules of conventional baseball. The game board and the card holders may be provided with illumination for enhancing appearance and facilitating nighttime play.

9 Claims, 5 Drawing Sheets

BASEBALL CARD BOARD GAME

BACKGROUND OF THE INVENTION

1. Field of the Invention

The present invention relates to games and more particularly pertains to a baseball card board game for simulating the game of baseball in which baseball trading cards are utilized as playing pieces.

2. Description of the Prior Art

The use of games is known in the prior art. More specifically, games heretofore devised and utilized for the purpose of simulating the game of baseball are known to consist basically of familiar, expected and obvious structural configurations, notwithstanding the myriad of designs encompassed by the crowded prior art which have been developed for the fulfillment of countless objectives and requirements.

For example, a baseball board game is illustrated in U.S. Pat. No. 4,261,569 which comprises a game board having a baseball diamond thereon, a random number generator in the form of a pair of differently colored dice, and a plurality of ball player cards including at least one pitcher and batters. The action is controlled by generation of random numbers and looking to the cards to determine in accordance with the number generated the batter's performance and a base runner's movement. The instructions on the cards are written so as to simulate the actual major league performance of the player who's name appears on it.

Another patent of interest is U.S. Pat. No. 4,230,316 which teaches a method of playing a baseball board game. The board game is played on a game board carrying colored indicia thereon and a predetermined play action surface area and non-action surface area. A game piece carrying indicia thereon determines the play action on the board by the through of the game piece. Markers are provided which are received in the apertures in the board to record the play action thereon, in accordance with the rules of baseball.

Other known prior art games include U.S. Pat. No. 5,129,651; U.S. Pat. No. 4,179,123; and U.S. Pat. No. 4,452,453.

While these devices fulfill their respective, particular objectives and requirements, the aforementioned patents do not disclose a baseball card board game for simulating the game of baseball which includes a board having a baseball diamond pictured thereon and a plurality of card holders into which baseball trading cards may be positioned for use as playing pieces, with a deck of pitcher cards providing a random pitch to a player at bat, and a deck of action cards providing a random result of the batter's action. Furthermore, none of the known prior art games teach or suggest a baseball card board game having the aforementioned structure and further including illumination means on both the game board and the card holders for enhancing appearance and facilitating nighttime play of the game.

In these respects, the baseball card board game according to the present invention substantially departs from the conventional concepts and designs of the prior art, and in so doing provides an apparatus primarily developed for the purpose of simulating the game of baseball and utilizing baseball trading cards for playing pieces.

SUMMARY OF THE INVENTION

In view of the foregoing disadvantages inherent in the known types of games now present in the prior art, the present invention provides a new baseball card board game construction wherein the same can be utilized for simulating the game of baseball. As such, the general purpose of the present invention, which will be described subsequently in greater detail, is to provide a new baseball card board game apparatus and method which has many of the advantages of the games mentioned heretofore and many novel features that result in a baseball card board game which is not anticipated, rendered obvious, suggested, or even implied by any of the prior art games, either alone or in any combination thereof.

To attain this, the present invention generally comprises a board game for simulating the game of baseball in which baseball trading cards are utilized as playing pieces. The game includes a board having a baseball diamond pictured thereon and a plurality of card holders into which baseball trading cards may be positioned. A deck of pitcher cards provides a random pitch to a player at bat, such as a strike, ball, or hit, and a deck of action cards provides a random result of the batter's action, such as a hit, out, or homerun. The game pieces are then moved in accordance with the rules of conventional baseball. The game board and the card holders may be provided with illumination means for enhancing appearance and facilitating nighttime play.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball card board game apparatus and method which has many of the advantages of the games mentioned heretofore and many novel features that result in a baseball card board game which is not anticipated, rendered obvious, suggested, or even implied by any of the prior art games, either alone or in any combination thereof.

It is another object of the present invention to provide a new baseball card board game which may be easily and efficiently manufactured and marketed.

It is a further object of the present invention to provide a new baseball card board game which is of a durable and reliable construction.

An even further object of the present invention is to provide a new baseball card board game which is susceptible of a low cost of manufacture with regard to both materials and labor, and which accordingly is then susceptible of low prices of sale to the consuming public, thereby making such baseball card board games economically available to the buying public.

Still yet another object of the present invention is to provide a new baseball card board game which provides in the apparatuses and methods of the prior art some of the advantages thereof, while simultaneously overcoming some of the disadvantages normally associated therewith.

Still another object of the present invention is to provide a new baseball card board game for simulating the game of baseball in which baseball trading cards are utilized as playing pieces.

Yet another object of the present invention is to provide a new baseball card board game which includes a board having a baseball diamond pictured thereon and a plurality of card holders into which baseball trading cards may be positioned, with a deck of pitcher cards providing a random pitch to a player at bat, and a deck of action cards providing a random result of the batter's action.

Even still another object of the present invention is to provide a new baseball card board game in which the game board and the card holders are provided with illumination means for enhancing the appearance and facilitating nighttime play.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
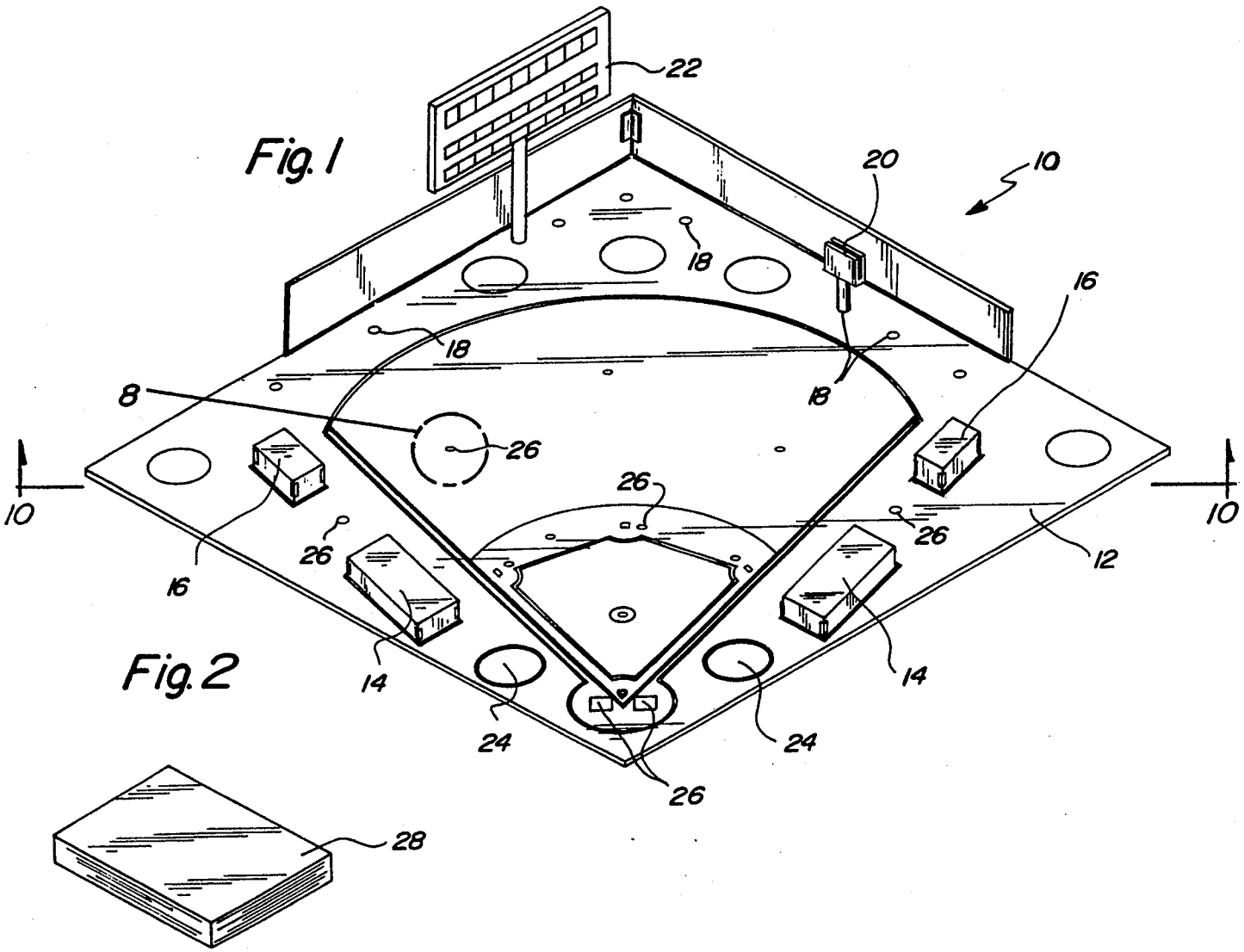
FIG. 1 is a perspective view of a baseball card board game comprising the present invention.
FIG. 2 is a perspective view of a plurality of baseball trading cards.

With reference now to the drawings, and in particular to FIGS. 1–12 thereof, a new baseball card board game embodying the principles and concepts of the present invention and generally designated by the reference numeral 10 will be described.

More specifically, it will be noted that the baseball card board game 10 comprises a game board 12 having a baseball playing field pictured thereon, as best illustrated in FIG. 1. The game board 12 includes a pair of folding dugouts 14 and a pair of folding bull pens 16 on opposed sided of the playing field. The dugouts 14 and the bull pens 16 may be collapsed to lie flat against the game board 12, or left erected such that objects may be stored therewithin. A plurality of board apertures 18 are positioned along a rear perimeter of the game board 12 and are operable to receive a spectator card holder 20 into which a trading card or the like may be positioned for display purposes, or an operative scoreboard 22, such scoreboard using conventional components to facilitate a selective display of a current score or the like. Warm-up areas 24, as well as a plurality of unlabeled, similarly shaped logo spots, are positioned on opposed sides of the baseball diamond, and a plurality of electrical bridges 26 are embedded within the game board 12 and arranged flush with the top surface thereof for purposes which will henceforth be more fully described.

Figure 6:
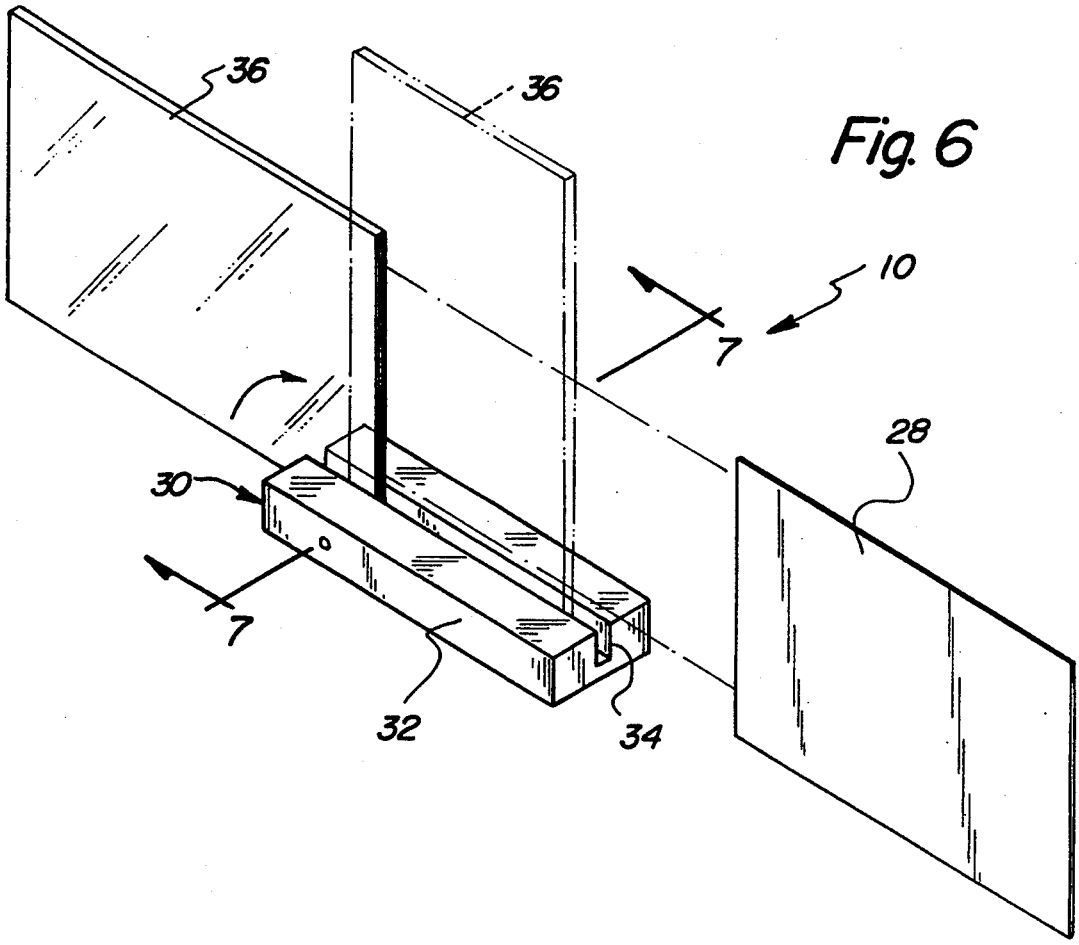
FIG. 6 is a perspective view of a card holder comprising a portion of the present invention.
Figure 7:
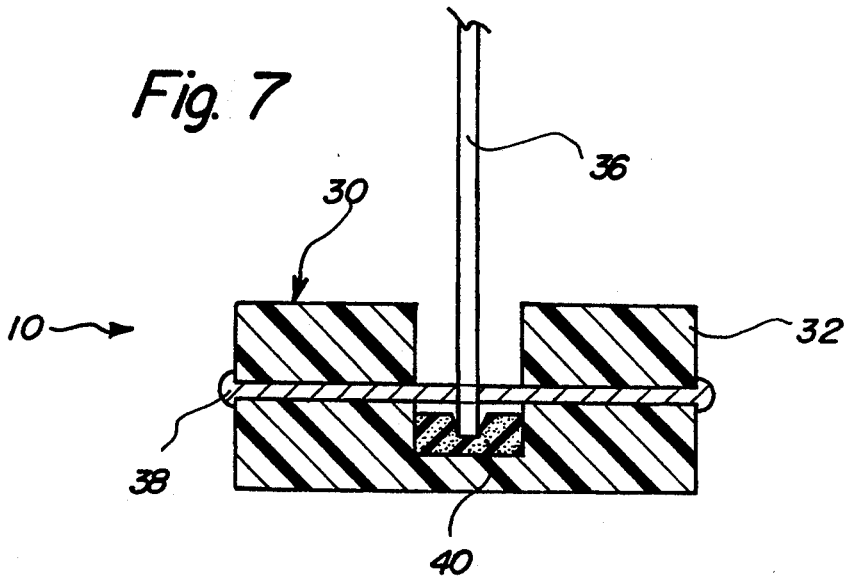
FIG. 7 is a cross sectional view taken along line 7—7 of FIG. 6.

The present invention 10 utilizes conventionally known and readily available sports trading cards 28, such as the baseball cards illustrated in FIG. 2. To facilitate an upright positioning of an individual one of the baseball cards 28, the baseball card may be positioned within a card holder 30, as illustrated in FIG. 6. The card holder 30 comprises a base 32 having a journal 34 extending longitudinally therealong. The journal 34 is operable to receive a portion of a transparent envelope 36 into which the baseball card 28 will be positioned. The transparent envelope 36 is pivotally mounted within the journal 34 by a pivot pin 38 which extends through both the base 32 and a portion of the envelope, as illustrated in FIG. 7. Such pivotal mounting allows the transparent envelope 36 to be pivoted from a horizontal position which facilitates lateral reception of the card 28 therewithin to a vertical position for displaying of the card, as shown in the phantom illustration of FIG. 6. A foam seal 40 is positioned within the journal 34 and operable to engage a lower edge of the transparent envelope 36. By this structure, a valuable or collectible baseball card 28 may be effectively protected against damage thereto while simultaneously permitting viewing thereof and use as a playing piece for the game 10.

The game 10 may be played by selecting two teams of at least one player or "manager" per team. Each player of each team may then select a plurality of baseball cards 28 to define a baseball team of up to approximately twenty-eight player cards, wherein nine of such cards are designated as starting players and nineteen of such cards are designated as reserve players. The cards 28 are then each positioned within an individual one of the card holders 30 and positioned upon the playing field in accordance with the position played by the real-life player depicted on each card. Any member or manager of either team may substitute a starting player for a reserve player at any time during the game. However, once a starting player has been taken out of the game, it is preferable that the starting player not be used again.

Figure 3:
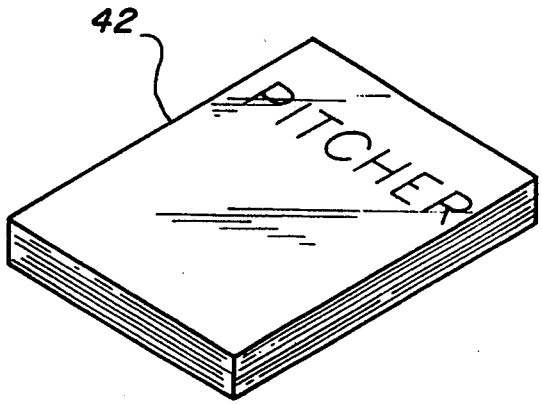
FIG. 3 is a perspective view of a plurality of pitcher cards for use during play of the present invention.
Figure 4:
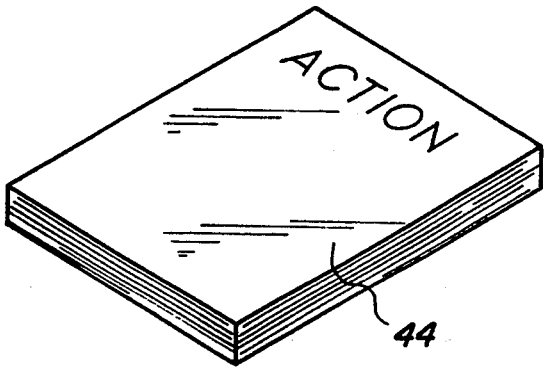
FIG. 4 is a perspective view of a plurality of action cards comprising a portion of the present invention.

During play, one of the two teams will bat while the other team plays the field. Initial selection of the batting team and the field team may be accomplished through the flipping of a coin or other similar chance device. After a batting team and a field team has been selected the field team then selects a pitcher card 42 from a plurality of such cards, as illustrated in FIG. 3. The pitcher cards are provided with indicia on a back thereof illustrating three different possible outcomes. To this end, the pitcher cards 42 comprise a "strike" card, a "hit" card, and a "ball" card, with the preferred embodiment of the present invention 10 including twenty strike cards, twenty hit cards, and twenty ball cards to form a deck of 60 pitcher cards 42. The field team selects one of the pitcher cards 42 and displays it to the batting team to reveal the pitch. The field team repeats the drawing of the pitcher cards 42 until a total of three strikes are revealed, a total of four balls are revealed, or a single hit card is revealed. For example, upon the drawing of three strike cards, the batting player of the batting team is called out. Upon reception of four ball cards 42, the batting player of the batting team advances to first base on the playing field. Should the batting team receive a hit card from the field team, the batter then draws one of a plurality of action cards 44, as illustrated in FIG. 4, to determine the resulting action of the hit.

Figure 5:
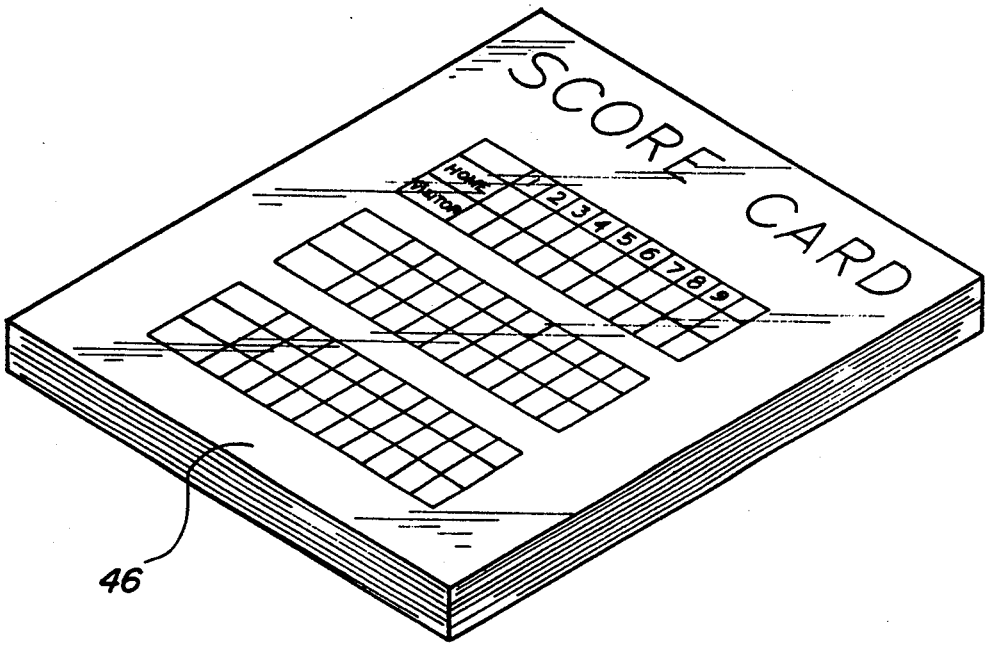
FIG. 5 is a perspective view of a plurality of score cards.

The action cards 44 comprise a plurality of cards with directive indicia displayed on a back of each of the cards which direct the player's action subsequent to the drawing of a hit card from the pitcher cards 42. The action cards 44 may each list any one of the conventionally known baseball plays, such as a single, a double, a triple, or a homerun, for example. In the preferred embodiment, the action cards 44 comprise a plurality of cards having the following approximate number of cards with each type of play written thereon:

12 Single play cards—Runners advance one base
3 Single play cards—Runners advance two bases
5 Double play cards—Runners advance two bases
2 Double,play cards—All runners score
3 Triple play cards
5 Homerun cards
8 Ground out to third cards—Runners advance one base
2 Ground out to third cards—Lead runner and batter out
8 Ground out to shortstop cards—Runners advance one base
2 Ground out to shortstop cards—Lead runner and batter out
3 Ground out to second base cards—Runners advance one base
2 Ground out to second base cards—Lead runner & batter out
2 Ground out to first base cards—Runners advance one base
1 Ground out to first base cards—Lead runner & batter out
7 Fly out to left cards—Runners hold position
1 Fly out to left cards—Runners advance one base
7 Fly out to center cards—Runners hold position
1 Fly out to center cards—Runners advance one base
7 Fly out to right cards—Runners hold position
1 Fly out to right cards—Runners advance one base
1 Pop fly out to third base—Runners hold position
1 Pop fly out to second base—Runners hold position
1 Pop fly out to shortstop—Runners hold position
1 Pop fly out to first base—Runners hold position
1 Foul out to catcher—Runners hold position
1 Foul out to third base—Runners hold position
1 Foul out to first base—Runners hold position Upon selection of an action card 44, in accordance with the selection of a previously drawn hit card 42, the players of the batting team may then be accordingly moved to the designated areas of the playing field. For example, the field team may draw a first strike card 42, a second strike card, and then a hit card. The batting team then draws an action card 44 which, for this example, may indicate "Single play—Runners advance one base", whereupon the trading card, in its associated holder, would then be moved from the home plate or batting area to first base and any runners on base would advance to the next base. Each team is allowed to receive only three outs per inning, with an entire game consisting of nine innings. As illustrated in FIG. 5, a plurality of score cards or line-up cards 46 are provided for keeping score during the game and keeping a record of the line-up of each team. In addition, it is contemplated that an additional plurality of action cards 44 may be provided without indicia thereon such that individual team players may customize the game by creating their own possible action plays, such as a balk, a stolen base, or a batter hit by a pitch, for example. The winner is determined by the team which has the greatest number of runs at the end of the game, just as is done with conventional baseball.

Figure 8:
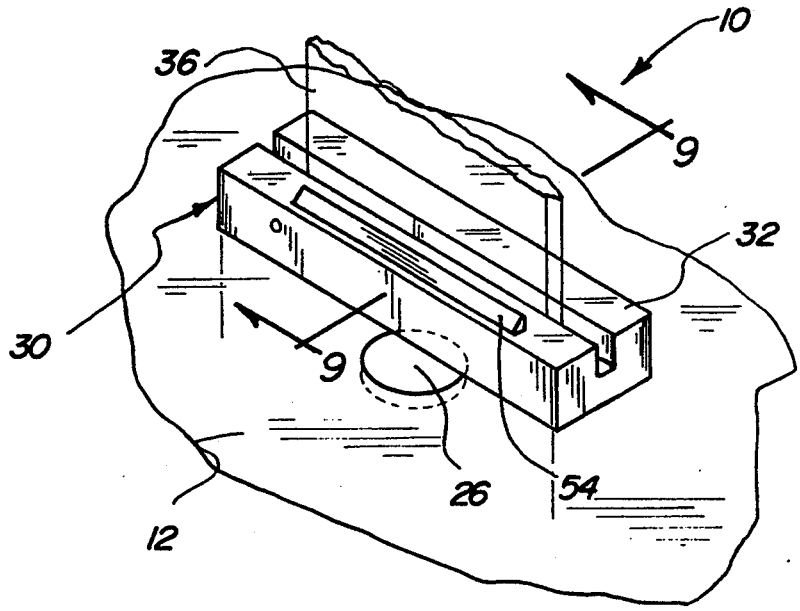
FIG. 8 is a perspective view of another card holder comprising a portion of the present invention.
Figure 9:
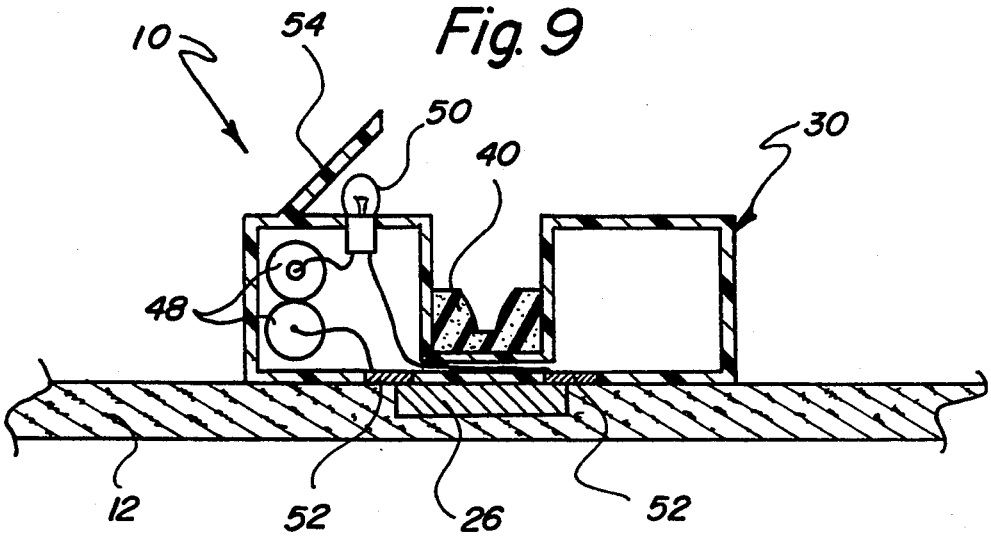
FIG. 9 is a cross sectional view taken along line 9—9 of FIG. 8.

Turning now to FIGS. 8 and 9 it can be shown that the card holder 30 of the present invention 10 may comprise a base 32 having an interior cavity within which a plurality of batteries 48 are stored. The batteries 48 are electrically connected by unlabeled wires to a light bulb 50 positioned upon a top of the base 32. The Wires extend towards a bottom of the base 32 and terminate in a pair of contacts 52, as best illustrated in FIG. 9. The contacts 52 are operable to be connected together by any one of the electrical bridges 26 positioned flush upon the top surface of the game board 12. Upon engagement of the contacts 52 with the electrical bridge 26, the circuit comprising the batteries 48 and the light bulb 50 will be completed to energized the light bulb in a well understood manner. A shade 54 is positioned immediately above the light bulb 50 and angled to deflect the generated light onto the transparent envelope 36 to illuminate the card 28 contained therein. By this structure, proper positioning of the cards 28 within each holder 30 upon the playing field is assured, and illumination of the cards is provided for enhancing appearance and facilitating nighttime play of the game 10. Additionally or Alternatively, a conventional switch may be electrically coupled to both the batteries 48 and the light bulb 50 to facilitate selective illumination thereof.

Figure 10:
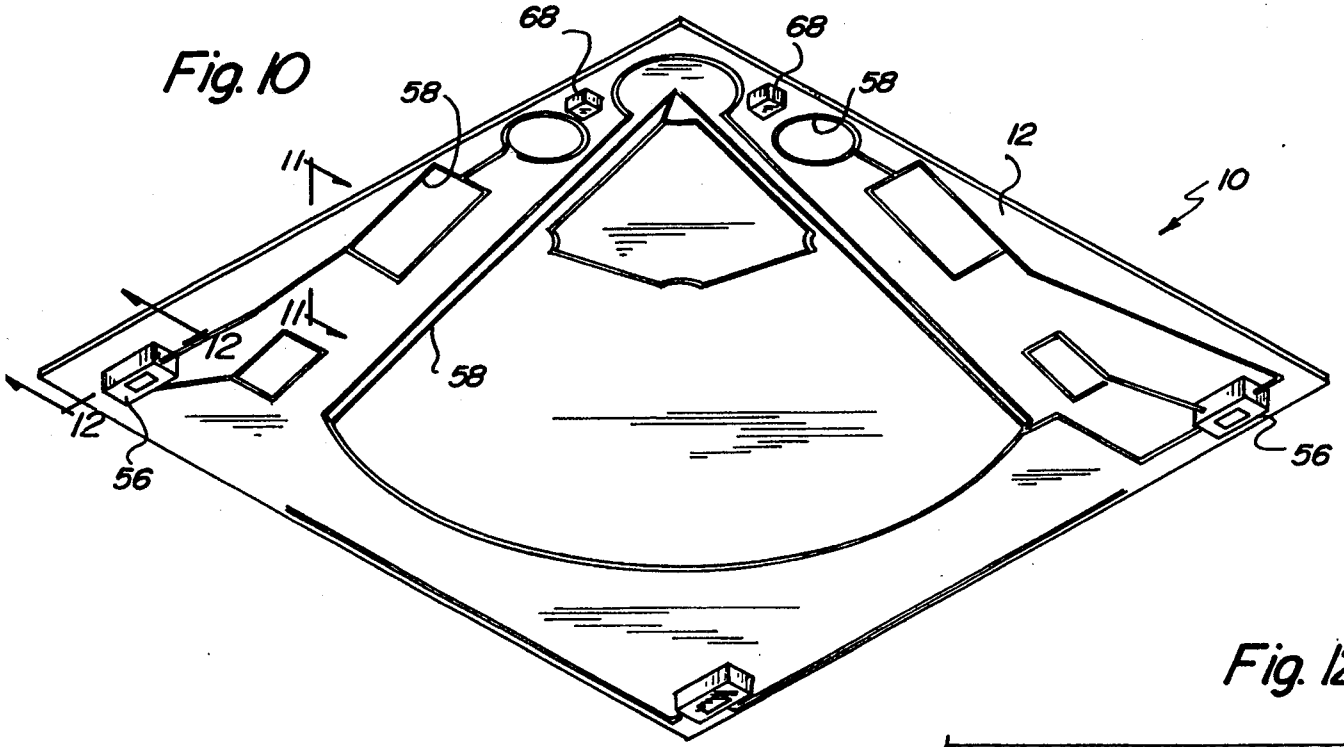
FIG. 10 is a bottom perspective view of the game board of the present invention illustrating a plurality of light emitting tubes.
Figure 12:
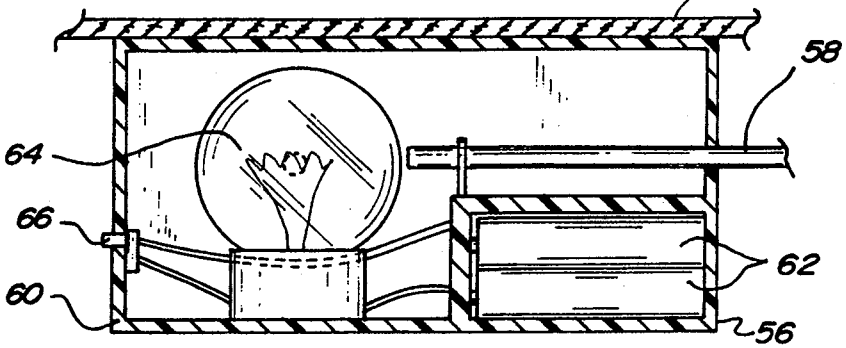
FIG. 12 is a cross sectional view taken along line 12—12 of FIG. 10.
Figure 11:
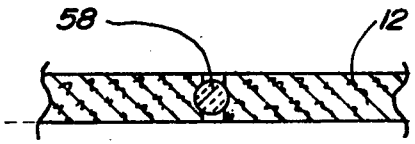
FIG. 11 is a cross sectional view taken along line 11—11 of FIG. 10.

FIG. 10 is a bottom perspective view of the game board 12, and it can be seen from this Figure that the game board may include a plurality of light sources 56 positioned upon a bottom surface of the game board and operable to supply light to a plurality of light emitting tubes 58 which extend through the game board for viewing from a top surface thereof, as illustrated in FIG. 11. More specifically, the light source 56 includes a housing 60 within which a further plurality of batteries 62, a light bulb 64, and a switch 66 are contained. The light bulb 64 is electrically connected to both the switch 66 and the batteries 62 such that the light bulb may be selectively energized through an actuation of the switch in a well understood manner. Each of the light sources 56 has one or more light emitting tubes 58 extending from a position adjacent the light bulb 64 to a position exterior of the housing 60 and into the game board 12, as illustrated in FIG. 11. By this structure, the perimeter of the playing field, the dugouts 14, the bull pens 16, and the warm-up areas 24 may be illuminated for ease of viewing and enhanced appearance thereof. The light sources 56 also support the game board 12 upon a playing surface, with a pair of additional feet 68 being provided for imparting further stability to the board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A baseball card board game comprising:

a game board having a baseball playing field pictured thereon;

and, at least one card holder means for receiving a trading card, displaying said card, and permitting use of said card as a playing piece during a playing of a game upon said game board, said card holder means including a base having a journal extending longitudinally therealong; a transparent envelope for receiving the trading card; a pivot pin extending through both the base and a portion of the envelope to pivotally mount the transparent envelope within the journal and allow the transparent envelope to be pivoted from a horizontal position which facilitates lateral reception of the card therewithin to a vertical position for displaying of the card; and a foam seal positioned within the journal and operable to engage a lower edge of the transparent envelope to seal said lower edge of the envelope.

2. The baseball card board game of claim 1, and further comprising a plurality of pitcher cards each having a back with indicia on said back thereof illustrating three disparate outcomes, said outcomes comprising an outcome selected from the group consisting of "strike", "ball" and "hit".

3. The baseball card board game of claim 2, and further comprising a plurality of action cards with each of said action cards having a back with directive indicia displayed on said back thereof.

4. The baseball card board game of claim 3, wherein of said directive indica of each of said action cards comprises an instruction selected from the group consisting of "Single play—Runners advance one base", "Single play—Runners advance two bases" "Double play—Runners advance two bases" "Double play—All runners score", "Triple play", "Homerun" , "Ground out to third—Runners advance one base", "Ground out to third—Lead runner and batter out", "Ground out to shortstop—Runners advance one base" "Ground out to shortstop—Lead runner and batter out" "Ground out to second base—Runners advance one base" "Ground out to second base—Lead runner & batter out", "Ground out to first base—Runners advance one base" "Ground out to first base—Lead runner & batter out" "Fly out to left—Runners hold position", "Fly out to left—Runners advance one base", "Fly out to center—Runners hold position", "Fly out to center—Runners advance one base", "Fly out to right—Runners hold position", "Fly out to right—Runners advance one base", "Pop fly out to third base—Runners hold position", "Pop fly out to second base—Runners hold position", "Pop fly out to shortstop—Runners hold position", "Pop fly out to first base—Runners hold position", "Foul out to catcher—Runners hold position", "Foul out to third base—Runners hold position", and "Foul out to first base—Runners hold position".

5. The baseball card board game of claim 4, wherein said plurality of pitcher cards comprises twenty "strike" cards, twenty "hit" cards, and twenty "ball" cards to form a deck of 60 pitcher cards.

6. The baseball card board game of claim 5, wherein said game board includes a pair of collapsible, folding dugouts and a pair of collapsible, folding bull pens positioned on opposed sided of said playing field, and further wherein said game board further includes a rear perimeter with a plurality of board apertures formed along said rear perimeter thereof.

7. The baseball card board game of claim 6, and further comprising at least one spectator card holder for holding a trading card for display purposes, said spectator card holder being removably positioned within one of said board apertures, and a scoreboard removably positioned within one of said board apertures.

8. The baseball card board game of claim 7, and further comprising a plurality of electrical bridges embedded within the game board and arranged flush with the top surface thereof; at least one battery positioned within said base of said card holder; a light bulb positioned upon said base for illumination of said transparent envelope; a first contact electrically connected to said at least one battery; and a second contact electrically connected to said light bulb, said contacts projecting exteriorly of said base to electrically engage one of said bridges to electrically couple said light bulb to said at least one battery and energize said light bulb when said card holder is positioned upon one of said bridges.

9. The baseball card board game of claim 8, and further comprising a plurality of light sources positioned upon a bottom surface of the game board; and a plurality of light emitting tubes in optical communication with said light sources, said light emitting tubes extending through the game board for viewing from a top surface thereof,

* * * * *